US012053691B2

(12) United States Patent
Trubnikov

(10) Patent No.: US 12,053,691 B2
(45) Date of Patent: Aug. 6, 2024

(54) PLATFORM FOR HOLDING EVENTS INCLUDING THE USE OF REPLICAS OF MEDIEVAL ARMOR AND/OR REPLICAS OF MEDIEVAL WEAPONS

(71) Applicant: Anton Andriiovych Trubnikov, Kharkov (UA)

(72) Inventor: Anton Andriiovych Trubnikov, Kharkov (UA)

( * ) Notice: Subject to any disclaimer, the term of this patent is extended or adjusted under 35 U.S.C. 154(b) by 301 days.

(21) Appl. No.: 17/557,609

(22) Filed: Dec. 21, 2021

(65) Prior Publication Data

US 2023/0191236 A1 Jun. 22, 2023

(51) Int. Cl.
*A63C 19/00* (2006.01)
*A63B 69/20* (2006.01)

(52) U.S. Cl.
CPC ..... *A63C 19/005* (2013.01); *A63B 69/215* (2022.08); *A63B 2244/10* (2013.01)

(58) Field of Classification Search
CPC ..... A63C 19/00; A63C 19/005; A63C 19/085; A63B 2244/10
USPC ..... 472/92–94
See application file for complete search history.

(56) References Cited

U.S. PATENT DOCUMENTS

| | | | |
|---|---|---|---|
| 5,720,678 A | 2/1998 | Korthauer | |
| 6,672,968 B2 | 1/2004 | Montolio | |
| D566,853 S | 4/2008 | Norris | |
| 8,109,835 B2 | 2/2012 | Norris | |
| 10,195,516 B2 | 2/2019 | Sakakibara | |
| 10,293,244 B2 | 5/2019 | Gurgel et al. | |
| 2011/0012310 A1 | 1/2011 | Anderton et al. | |
| 2014/0213378 A1 | 7/2014 | Norris | |
| 2020/0315385 A1* | 10/2020 | Johnson | B32B 3/06 |

FOREIGN PATENT DOCUMENTS

| | | | |
|---|---|---|---|
| AU | 2006284534 | A1 | 3/2007 |
| CA | 2241677 | A1 | 1/1999 |
| CN | 103768782 | A | 5/2014 |
| ES | 2798223 | A1 | 12/2020 |
| JP | H075677 | U | 1/1995 |
| JP | 5789347 | B1 | 10/2015 |
| UA | 65800 | U | 12/2011 |
| UA | 202102251 | | 4/2021 |
| WO | 2019147691 | A1 | 8/2019 |

OTHER PUBLICATIONS

International Search Report and Written Opinion issued on Apr. 12, 2023, in corresponding International Application No. PCT/IB2022/062633, 12 pages.

(Continued)

*Primary Examiner* — Kien T Nguyen
(74) *Attorney, Agent, or Firm* — Maier & Maier, PLLC

(57) ABSTRACT

A platform for holding events including the use of replicas of medieval armor and/or replicas of medieval weapons, including a battle area located on a supporting structure at a level above the platform base, and smooth slopes extending downward along the entire perimeter from the sides of the battle area and having a base of hard material and executed with a soft coating, wherein a stumbling barrier is located along the entire perimeter or along two opposite sides of the battle area.

17 Claims, 3 Drawing Sheets

(56) References Cited

OTHER PUBLICATIONS

Anonymous, "Sumo Dohyo | Sumo Ring Dimensions & Drawings", Retrieved from the Internet: URL:https://www.dimensions.com/element/sumo-dohyo-sumo-ring, Aug. 25, 2020, XP093036336, 4 pages.
Smoushkevich.,"Sports Sword", Department of Education and Science of the City of Moscow, 2020; 20 pages with Abstract.
Pelgrom., "Anonymous: King René's Tournament Book (1480-1488)", Art in Space, Jun. 17, 2020; 4 pages.

* cited by examiner

PLATFORM FOR HOLDING EVENTS INCLUDING THE USE OF REPLICAS OF MEDIEVAL ARMOR AND/OR REPLICAS OF MEDIEVAL WEAPONS

FIELD

The present invention relates to equipment for sports and entertainment events, namely equipment for holding training sessions, competitions, showcase performances, etc.

BACKGROUND

Knight tournaments, known since the Middle Ages, nowadays have taken the form of full-contact battles in armor. For example, historical medieval battle (hereinafter referred to as HMB), is a modern sport that began its development in the late 1990s. HMB is full-contact combat with the use of offensive and defensive weapons characteristic of the Middle Ages, wherein the combatants are dressed in full armor, that, like weapons, is made according to historical specimens. To reduce the injury rate, armor and weapons used in HMB are made blunt. In addition, the striking edge of the weapon has a special rounding, and additional elements of concealed protection are provided in the armor. The equipment is carefully checked by the referees before the start of the battle.

Full-contact battles in armor, such as, for example, HMB, are a sports component of the historical reconstruction of the Middle Ages, but, unlike showcase battles, that are most often held at festivals of historical reconstruction, full-contact battles take place under the condition of full contact with the participation of sports referees, who have specialized training and experience of participation in such battles. In full-contact battles in armor, strikes are delivered to any part of the body taking into account some restrictions. At the same time, both percussion and wrestling techniques are allowed.

Local tournaments and international championships are held in full-contact battles in armor. The format of the competition may include both one-on-one battles of rivals, and mass battles of teams of 5-21 participants, or holding buhurts (group battles, squad-on-squad battles).

Usually, buhurts continue for as long as the combatant remains on his feet. The fallen participant is withdrawn from the battle. It is forbidden to beat the lying participants. Accordingly, in order to win, it is required to either knock down the enemy or inflict such blows on him so that he decides to fall himself. According to the rules for conducting mass battles, a participant is considered to be defeated when he falls on or outside the battle area.

In addition to weapons and protective armor, for holding full-contact battles in armor, it is also necessary to provide an appropriate place for the battle—tiltyard. A tiltyard is a place where fierce battles take place, it is the most essential component of full-contact battles in armor, as the safety of both combatants and spectators depends thereon.

In the Middle Ages, the tiltyard was usually a playing field for equestrian competitions, but subsequently, it began to be used for dismounted battles. The oldest tiltyards were part of the field with places reserved for recreational purposes. As from the thirteenth century, the battlefield began to be fenced off with a palisade and a moat. Subsequently, an additional safety fence for the safety of spectators was added (http://art-in-space.blogspot.com/2020/06/anonymous-king-renes-tournament-book.html).

In general, the size of the tiltyard depended on the type of competition, the number of participants and spectators. It happened that tournaments were held in the field, without a specifically prepared area. In particular, during the war, the knights of the opposing sides competed in this manner.

Nowadays, it is mainly dismounted battles that are held on the tiltyard. In modern full-contact battles in armor, the dimensions of the tiltyard are calculated in such a way that, on the one hand, the combatants could maneuver, and on the other hand, they would not be forced to chase one another over a large territory for far too long. Excessively enlarged space is also undesirable, as it makes it more difficult for the referees to observe the battles.

Construction of the tiltyard includes a surface that the fight takes place on, and a safety fence separating the combatants from the audience.

The surface of the tiltyard is to be smooth and even, taking into account that any unevenness may lead to the traumatization of participants of the full-contact battle in armor.

In the well-known examples of full-contact battles in armor, natural landscapes are selected for the placement of the tiltyard—fields or earthen areas, which are gentrified and fenced off with a specially installed safety fence. If possible, the tiltyard is made even by strewing it with a coating layer—earth or sand, but it can be just flat, trotten and solid ground.

The safety fence is usually a structure of solid wood that can withstand the pressure of combatants falling thereon. In order to achieve this, when creating the safety fence, corresponding calculations are made, the structure is equipped with stiffening pieces, external supporting elements that do not allow it to fall during the battle.

Should the safety fence have no required durability, the risk of traumatization of participants in full-contact battles in armor and spectators who are directly next to the safety fence increases.

The existing constructions of tiltyards for full-contact battles in armor have a number of disadvantages. Considering that the competitions are organized directly on the ground, on the natural landscape, there is a need to find a place which characteristics make it suitable for use before holding each tournament or competition. At the same time, there are no guarantees that such a place will fully meet all the selection criteria.

In addition, the ground area chosen for the placement of the tiltyard is to be equipped, cleared from stones, plants, and other objects that may get in the way of participants during the battle. Additionally, if the territory is hilly, the ground area needs to be leveled or a top layer of sand needs to be strewed.

This significantly complicates the process of placing the tiltyard, requires additional time, effort, and investments.

In addition, the tiltyard located on the natural landscape depends on the influence of weather—rain and other types of precipitation can make it completely unusable.

The safety fence does not completely exclude the risk of deformation thereof during the battle, breaking or falling away from the center of the tiltyard, where spectators may be placed. In addition, in order to minimize such risks, the construction of the safety fence is executed strong and heavy, and when a combatant collides with such an obstacle, there is a high risk of injury.

The safety fence can also interfere with the implementation of the aesthetic function of full-contact battles in armor, namely, limit the visibility of the tiltyard and combatants for spectators.

In addition, during the battle, combatants may use a high safety fence when retreating to avoid falling, namely, hold on to the safety fence, or lean back thereon and continue the battle. Such actions of the participants delay the process of the battle and do not contribute to visual appeal thereof, which is the main purpose of organizing such battles.

From the state of the art, a tiltyard is known that does not have a fence or barrier (https://st.educom.ru/eduoffices/gateways/get_file.php?id=%7B7F803213-3494-A6ED-B5F9-CC9468ED2DA5%7D&name=%D0%A1portivnyy-mech2020.pdf). The boundaries of such a tiltyard are outlined directly on the ground for informative purposes.

The disadvantage of such a tiltyard is that spectators should be located away from it for the sake of safety. At the same time, the participants during the battle, due to specifics thereof, cannot always determine where the boundaries of the tiltyard are and go beyond them, which has negative consequences for the participant or team, because they are assigned penalties, or announced to be defeated in the battle.

From the state of the art, technical solutions are known that eliminate to some extent the disadvantages of the well-known construction of the tiltyard.

For example, the closest analogue for the device according to the present invention is a device according to Ukrainian patent application No. a 2021 02251. The device disclosed therein is a platform for holding events including the use of replicas of medieval armor and/or replicas of medieval weapons, comprising a battle area located at a level above the platform base and smooth slopes extending downward from the sides of the battle area. According to Ukrainian patent application No. a 2021 02251, the battle area is located on a supporting structure, and the smooth slopes have a base of hard material and are executed with a soft coating.

There is no safety fence in the abovementioned construction of the platform. Due to this, the platform provides full visibility of the battle. However, in the absence of a safety fence, the fall trajectory of participants of full-contact battles in armor from the battle area is quite significant, and in case the speed of movement of a combatant when crossing the perimeter of the battle area is too high, there is a possibility that he can fly over the smooth slope of the platform with a soft coating and land outside surface thereof. Considering that the height of the platform disclosed in application No. a 2021 02251 is 2.7 meters, a fall from such a height can result in injury of a participant of the battle. In addition, when leaving the limits of the battle area, there is a high probability that the participant will land unsuccessfully on his feet when falling, which carries a high risk of injury.

In addition to the insufficient level of safety, there is also a disadvantage that the fall of a combatant when leaving the limits of the battle area is not sufficiently spectacular and interesting for the viewer, which reduces commercial attractiveness.

Thus, the disadvantage of such a construction is the lack of a means that ensures a spectacular and safe fall and successful landing of a participant of full-contact battles in armor when crossing the perimeter of the battle area, including falling from the platform.

SUMMARY

The present invention may be used for any activity, including events with the use of replicas of medieval armor and/or replicas of medieval weapons. Such events can include, for example, full-contact battles in armor, in particular, historical medieval battle (HMB), medieval battle, historical fencing, competitions in historical European martial arts, etc., as well as other events including the use of replicas of medieval armor and/or replicas of medieval weapons such as live-action role-playing games, etc.

An objective of the present invention is to create a construction of the platform for holding events including the use of replicas of medieval armor and/or replicas of medieval weapons, which ensures the safety of participants of the battle, a low injury rate for combatants when falling outside the battle area, even at a high speed of movement of a combatant, which is stable and durable, and simple and easy to install, made of affordable and cheap materials, while providing sufficient opportunity to see the battle and a high degree of entertainment for the audience.

This objective is achieved by the fact that a platform for holding events including the use of replicas of medieval armor and/or replicas of medieval weapons, including a battle area located on a supporting structure at a level above the platform base, and smooth slopes extending downward along the entire perimeter from the sides of the battle area and having a base of hard material and executed with a soft coating, according to the present invention, wherein a stumbling barrier is provided along the entire perimeter or along two opposite sides of the battle area, while the height of the stumbling barrier is 20-40 centimeters.

The durable and rigid supporting structure of the battle area and the slopes have a base of solid material adapted to sustain the loads that arise from the weight of the combatants. Such loads are 800 kg/m$^2$ in case of a short-term effect, and 300 kg/m$^2$ under dynamic application of a concentrated load. The soft coating of the slopes ensures a low rate of injury to the combatants when they successfully land.

The maximum probability of successful landing is further ensured by the stumbling barrier installed closer to the edges of the battle area for conducting the battle along the entire perimeter or along two opposite sides thereof, where the participant is most likely to exit the battle area.

The term "stumbling barrier" should be understood as a barrier over which the participant of the battle is to stumble when he is out of the limits of the battle area. The stumbling barrier provides that the participant standing next to it and being pushed out of the battle area perimeter, bumps his foot with the stumbling barrier and is not able to find any point of support. For this purpose, the stumbling barrier may be provided in different variations, which are disclosed herein in the following exemplary and non-limiting embodiments of the invention.

The specified height of the stumbling barrier is important and choice thereof is based on the fact that, on the one hand, if a combatant comes into contact with a barrier of such height, he will not receive an injury to the knee joints, and, on the other hand, the barrier is high enough to prevent the participant from stepping over it while causing the participant to trip over it.

The advantage of having such a barrier is that, when a participant stumbles over it, the upper part of his body continues to move out of the battle area by inertia, while his legs, clinging to the stumbling barrier, linger on the battle area for some time. Thus, in the event of being pushed out or exiting the limits of the battle area, the participant falls on the soft surface of the slope with the maximum surface of his body, thus ensuring his safe landing.

Alternatively, landing, for example, on the feet, which is highly probable when leaving the limits of the battle area in the absence of the specified stumbling barrier, has a high risk of serious injury from poor contact of the feet with the soft slopes despite the cushioning properties of the soft slopes. In particular, such landing often leads to dislocations and fractures of the legs.

In addition, in the event of a fall after stumbling over the stumbling barrier, the participant falls along a smaller trajectory than when falling without such an obstacle, which makes landing safer, because it reduces the probability of falling outside the soft coating of the smooth slopes.

At the same time, such stumbling barrier does not create obstacles to the visibility of the battle, and cannot be used by participants of full-contact battles in armor either as a means of keeping them on the battlefield or as a support structure that will prevent fall thereof and loss in the battle. Moreover, the stumbling barrier can increase the visual appeal of battles, since the fall of a participant who stumbled over the stumbling barrier, lost balance, and is waving his arms while falling, is a more attention-grabbing and interesting sight for spectators than just the fall of a participant who left the battle area without a stumbling barrier.

Thus, construction of the platform with stumbling barrier reduces the risk of injury to combatants, additionally serves to ensure the compactness of the entire structure of the platform and completely eliminates the need to use a high fence, which can be a likely cause of injury to a combatant in contact therewith and an obstacle to the visibility of the battle.

Moreover, such a construction of the platform increases the competitiveness for combatants of different weight categories, wherein a combatant with a lighter weight has the opportunity, if not to strike, then at least to push a combatant with a heavier weight out of the platform, using the stumbling barrier as a tripping means, which helps to knock another combatant off his feet. The abovementioned adds dynamics and visual appeal to the battle.

In the most preferred embodiment of the present invention, to provide a simple and economical embodiment, ropes, or cables, or chains, or other similar means stretched between posts are used as a stumbling barrier. The posts can be located at a distance of 50-150 centimeters, which, with economical use of materials, allows to ensure the proper tension of the cable.

In another embodiment of the present invention, a strip of soft elastic material is used as a stumbling barrier. The execution of the stumbling barrier in the form of such a strip, for example, 20-30 centimeters thick, is another simple and economical embodiment, providing an even higher level of safety for participants, since it significantly reduces the risk of injury to a participant if he accidentally falls on such a stumbling barrier. Foam rubber, a mixture of foam rubber with bamboo or gel filler, crumb rubber, and the like can be used as soft elastic material. The specified material, if necessary, can be packed in a case to ensure the desired shape of the strip when placed on the battle area.

In one of the preferred embodiments of the present invention, a height of the stumbling barrier is 30-35 centimeters. Firstly, the height in the specified range is selected in such a way so that it is most likely to be higher than the height of the ankle joint and lower than the height of the knee joint of the participant. This minimizes the risk of injury to the leg joints as a result of contact with the stumbling barrier when the participant is pushed out or leaves the limits of the battle area. Secondly, the stumbling barrier that is 30-35 centimeters high reduces the likelihood of a participant stepping over them and, accordingly, an unpredictable and dangerous fall.

In one of the preferred embodiments of the present invention, the smooth slopes have an angle of inclination to the horizon ranging from 6 to 46 degrees, while the minimum length of the inclined surface thereof is from 3.5 meters. Execution of the smooth slopes with such parameters provides that when leaving the limits of the battle area, the participant, after stumbling over the stumbling barrier, will accurately hit the surface of the smooth slopes, and his contact with the said surface and further slowing down of his fall and rolling down will occur with the least likelihood of injury. The angle of inclination was selected taking into account the specifics of the events for which the platform is intended because when using replicas of medieval armor and/or replicas of medieval weapons, the weight of the participant and the dynamics of his fall outside the battle area significantly increase.

In the preferred embodiment of the present invention, a soft skirting is made along the perimeter formed by the lower edges of the slopes. It provides smooth deacceleration and serves as an additional means to reduce the risk of injury to participants falling from the battle area. The skirting can be attached to the lower planks of the slopes using belts or stitched-in brackets. The width of the soft skirting, sufficient to ensure the said function, is from 2 meters. For better shock absorption, the skirting can be made of foam rubber or other shock-absorbing material and is 70 to 100 centimeters thick.

In one of the preferred embodiments of the invention, mats with a soft filler can be used as a soft coating, which in total cover the entire surface of the slopes, have a thickness from 20 to 100 centimeters, in particular from 30 to 40 centimeters and are attached to the base of the slope made of hard material with any suitable means—glue, ropes, wires and the like. The said execution of the slopes is simple and economical, and at the same time ensures a low level of injuries to participants falling on the soft surface of the slopes.

The soft filler can be any material known in the art that provides shock absorption sufficient for the safe landing of participants. In particular, the same material can be used as for the stumbling barrier in the form of strips according to one of the previous embodiments of the invention. It can be foam rubber, a mixture of foam rubber with bamboo or gel filler, crumb rubber, and the like. At the same time, the soft coating on the slopes can be additionally covered with a decorative coating imitating grass or any other decorative coating.

Another preferred embodiment of the present invention is provided with a deepening filled with sand is provided on the entire surface of the battle area. The deepening on the surface of the battle area is formed by additional side walls located around the perimeter of the battle area, which allow keeping sand on the surface of the battle area. In this case, the upper edge of the smooth slopes of the platform is at the level of the upper edge of the additional side walls. The height of the additional side walls can be from 7 to 10 centimeters. Such a construction of the battle area ensures sufficient shock absorption thereof, good adhesion to the footwear of the participants, protection from mechanical damage, and is simple and cheap to execute.

The invention can be reproduced using known equipment according to existing technologies.

BRIEF DESCRIPTION OF THE FIGURES

The following is a detailed example of the implementation of the invention with reference to the drawings, which, however, should not be considered as such that limits the scope of the legal protection defined by the claims, namely:

DETAILED DESCRIPTION

Figure 1:
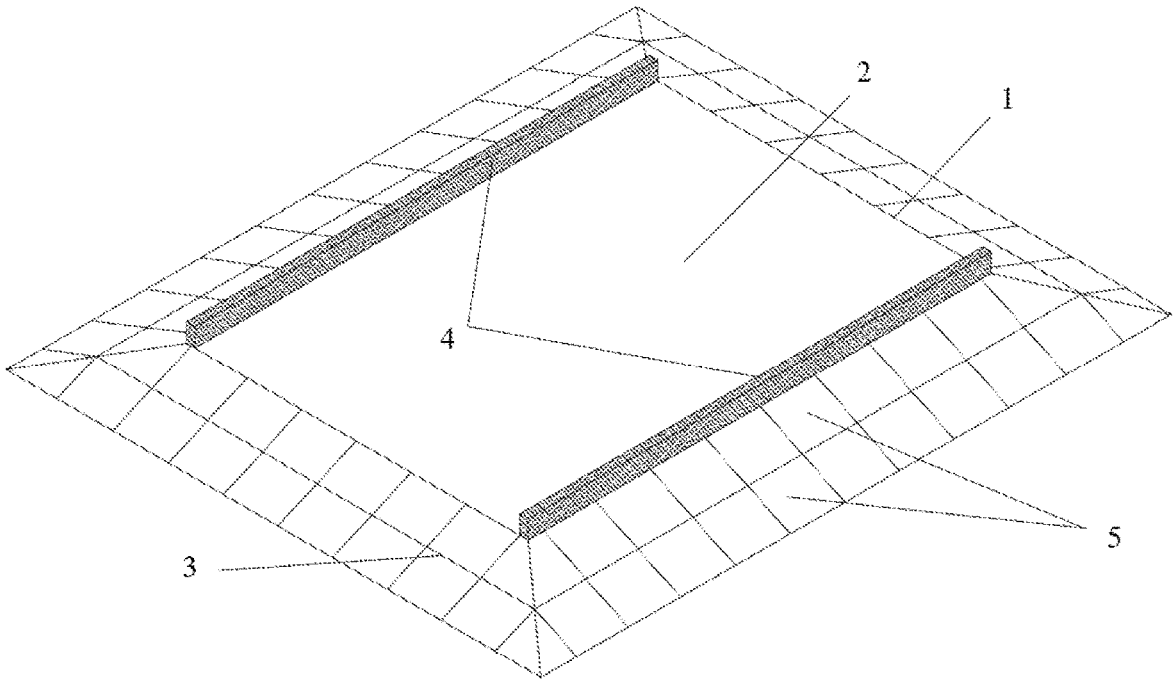
FIG. 1 is a general view of the platform with stumbling barriers installed along two sides.
Figure 2:
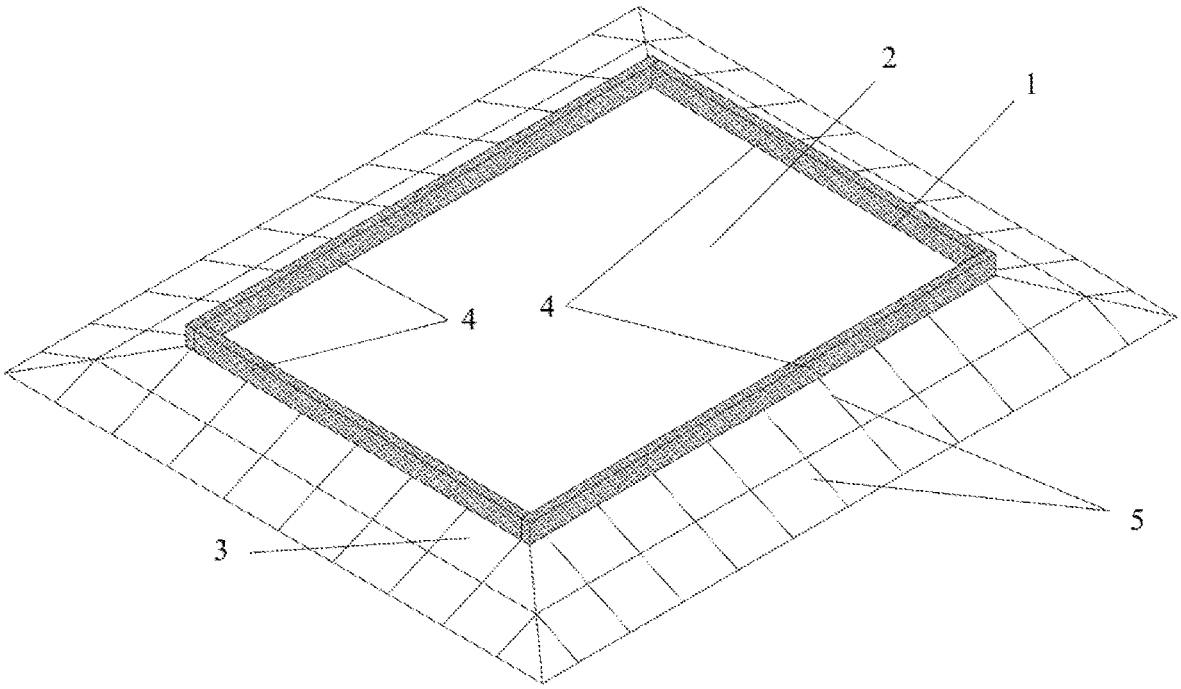
FIG. 2 is a general view of the platform with stumbling barriers installed along four sides.

The platform for holding events including the use of replicas of medieval armor and/or replicas of medieval weapons, as shown in FIG. 1, includes a battle area 1 located on a supporting structure with a deepening 2 filled with sand, smooth slopes 3 extending downward from the sides of the platform, and a stumbling barrier, which may be in the form of strips of soft elastic material 4 located on the battle area 1 along two opposite sides of the platform closer to the edge. In an exemplary embodiment of the platform, as shown in FIG. 2, the strips of soft elastic material 4 are located along four sides thereof.

Soft mats 5 are located on the smooth slopes 3 of the platform.

The platform has a height of 1.2 meters and is in the form of a truncated pyramid with a rectangular base. In this case, the sides of the lower plane formed by the lower edges of the slopes 3 have a length of 16.28 and 31.28 meters, and the sides of the upper plane of the platform formed by the upper edges of the slopes are 3-10 and 25 meters long, respectively.

The slopes 3 of the platform are smooth, while the angle of inclination thereof to the horizon is 19 degrees, and the length of the inclined surface is 3.70 meters.

Figure 3:
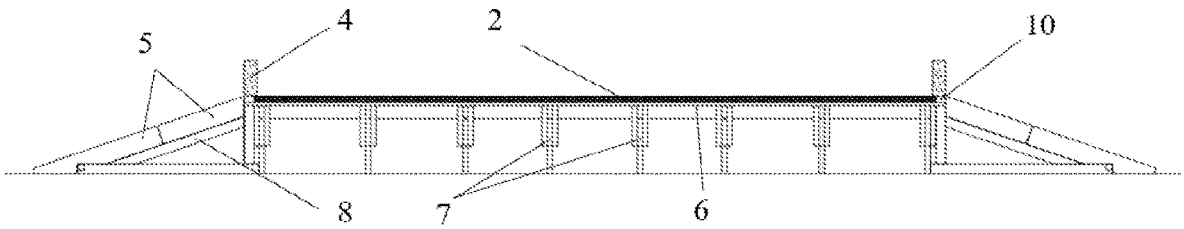
FIG. 3 is a schematic cross-sectional view of the platform.

The supporting structure of the platform (FIG. 3) consists of reinforced concrete support pads with anchor blocks and a wooden frame.

The wooden frame is made of horizontal beams of decking 6 and wooden columns 7 having a metal base. The decking 6 is made with LVL beams 42 millimeters thick.

In the central part of the wooden frame of the platform, a technical passage for personnel is provided.

The support pads have anchors protruding from the surface thereof, to which the metal bases of the wooden columns 7 are attached, and additional supporting means 8 are installed on the wooden columns 7 located along the battle area to hold the slopes 3 of the platform.

Figure 4:
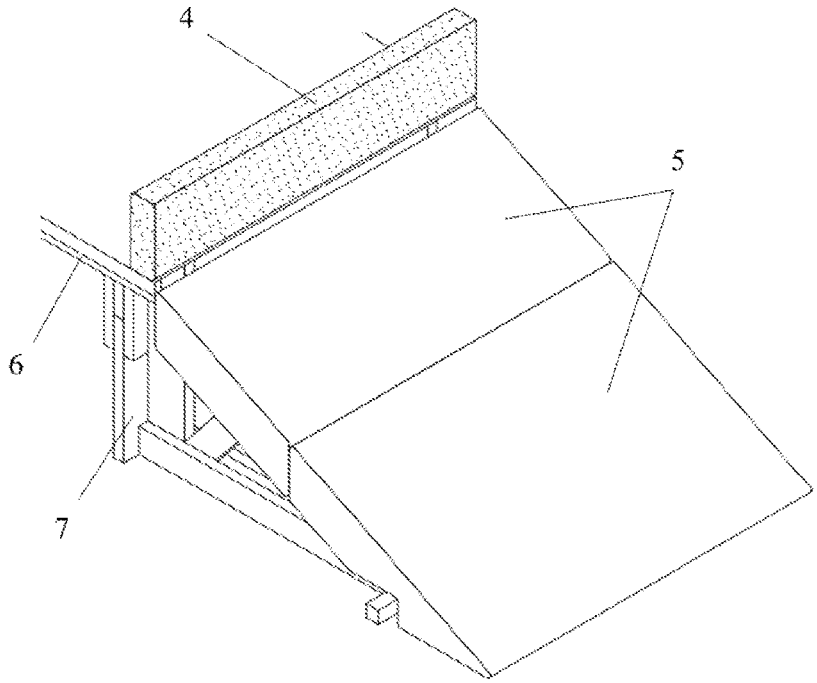
FIG. 4 is a schematic general view of the slope.
Figure 5:
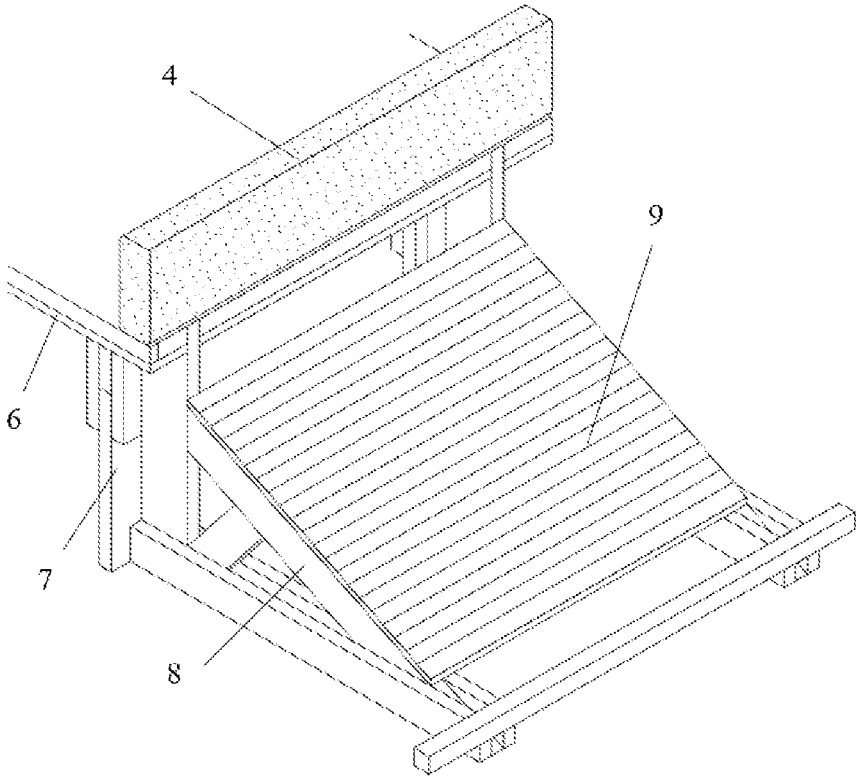
FIG. 5 is a schematic view of the slope without a soft coating.

Slopes 3 (FIG. 4-5) comprise wooden horizontal planks 9, fixed on additional supporting means 8 of the frame, and soft mats 5, which are glued to the outer surface of the wooden horizontal planks 9. The thickness of the soft mats 5 is 50 centimeters, they cover the entire surface of the slopes 3. The filler of the soft mats 5 is made of foam rubber, and the cover is made of PVC fabric.

The battle area 1 has a deepening 2 filled with sand throughout the entire area, formed by additional side walls 10 of the battle area 1 fitting tightly to the frame of the platform, wherein the upper edges of the additional side walls 10 are located at the same level with the upper edges of the smooth slopes 3. The height of the additional side walls 10 is 7 centimeters.

The height of the strips of soft elastic material located along the sides of the battle area 1 is 35 centimeters.

The construction of the platform according to the present invention ensures the safety of participants of full-contact battles in armor, a low risk of injury to combatants, also when a combatant falls outside the platform, even at a high speed of movement of the combatant, and creates good visibility and visual appeal of the battle for spectators.

Also, the construction of the platform according to the present invention is stable and durable, provides a balance of reliability, simplicity, and ease of installation, and is made of affordable and cheap materials.

The invention claimed is:

1. A platform for holding events including the use of replicas of medieval armor and/or replicas of medieval weapons, comprising:

a battle area located on a supporting structure at a level above a platform base;

smooth slopes extending downward along the entire perimeter from sides of the battle area and having a base of hard material and executed with a soft coating; and a stumbling barrier located along at least two opposite sides of the battle area;

wherein a height of the stumbling barrier constitutes 20-40 centimeters; and wherein posts with ropes, cables, and/or chains stretched therebetween are used as the stumbling barrier.

2. The platform according to claim 1, wherein the height of the stumbling barrier is 25-35 centimeters.

3. The platform according to claim 1, wherein the smooth slopes have an angle of inclination from 6 to 46 degrees, and a minimum length of an inclined surface of the smooth slopes is 3.5 meters.

4. A platform for holding events including the use of replicas of medieval armor and/or replicas of medieval weapons, comprising:

a battle area located on a supporting structure at a level above a platform base;

smooth slopes extending downward along the entire perimeter from sides of the battle area and having a base of hard material and executed with a soft coating; and a stumbling barrier located along at least two opposite sides of the battle area;

wherein a height of the stumbling barrier constitutes 20-40 centimeters; and wherein, along the perimeter formed by lower edges of the smooth slopes, there is a soft skirting for deacceleration with a minimum width of 2 meters.

5. The platform according to claim 4, wherein posts with ropes, cables, and/or chains stretched therebetween are used as the stumbling barrier.

6. The platform according to claim 4, wherein a strip of soft elastic material is used as the stumbling barrier.

7. The platform according to claim 4, wherein the smooth slopes have an angle of inclination from 6 to 46 degrees, and a minimum length of an inclined surface of the smooth slopes is 3.5 meters.

8. A platform for holding events including the use of replicas of medieval armor and/or replicas of medieval weapons, comprising:

a battle area located on a supporting structure at a level above a platform base;

smooth slopes extending downward along the entire perimeter from sides of the battle area and having a base of hard material and executed with a soft coating; and a stumbling barrier located along at least two opposite sides of the battle area;

wherein a height of the stumbling barrier constitutes 20-40 centimeters; and wherein mats with a soft filler are used as the soft coating, which in total cover an entire surface of the smooth slopes, have a thickness from 20 to 100 centimeters, and are attached to the base of the smooth slopes using glue, ropes, and/or wires.

9. The platform according to claim 8, wherein the thickness of the mats is 30 to 40 centimeters.

10. The platform according to claim 8, wherein posts with ropes, cables, and/or chains stretched therebetween are used as the stumbling barrier.

11. The platform according to claim 8, wherein a strip of soft elastic material is used as the stumbling barrier.

12. The platform according to claim 8, wherein the smooth slopes have an angle of inclination from 6 to 46 degrees, and a minimum length of an inclined surface of the smooth slopes is 3.5 meters.

13. A platform for holding events including the use of replicas of medieval armor and/or replicas of medieval weapons, comprising:

a battle area located on a supporting structure at a level above a platform base;

smooth slopes extending downward along the entire perimeter from sides of the battle area and having a base of hard material and executed with a soft coating; and a stumbling barrier located along at least two opposite sides of the battle area;

wherein a height of the stumbling barrier constitutes 20-40 centimeters; and wherein the battle area has a deepening filled with sand throughout the entire area, formed by additional side walls located around the perimeter of the battle area, wherein upper edges of the additional side walls are located at a same level with upper edges of the smooth slopes.

14. The platform according to claim 13, wherein a height of the additional side walls of the battle area is from 7 to 10 centimeters.

15. The platform according to claim 13, wherein posts with ropes, cables, and/or chains stretched therebetween are used as the stumbling barrier.

16. The platform according to claim 13, wherein a strip of soft elastic material is used as the stumbling barrier.

17. The platform according to claim 13, wherein the smooth slopes have an angle of inclination from 6 to 46 degrees, and a minimum length of an inclined surface of the smooth slopes is 3.5 meters.

* * * * *